United States Patent [19]

Dhugues et al.

[11] 4,040,253

[45] Aug. 9, 1977

[54] APPARATUS FOR TREATING EXHAUST GASES OF INTERNAL COMBUSTION ENGINES

[76] Inventors: Paul Dhugues, 40 rue du Capitaine Portales, Beausejour; Francois Zanca, 5, rue Canizares, both of Casablanca, Morocco

[21] Appl. No.: 191,257

[22] Filed: Oct. 21, 1971

[30] Foreign Application Priority Data

Nov. 20, 1970 France ..... 70.41681

[51] Int. Cl.[2] ..... F01N 3/14

[52] U.S. Cl. ..... 60/303; 23/277 C

[58] Field of Search ..... 60/303, 286, 297, 300, 60/299; 23/277 C, 288 F

[56] References Cited

U.S. PATENT DOCUMENTS

| | | | |
|---|---|---|---|
| 2,038,567 | 4/1936 | Ittner | 60/303 |
| 3,066,755 | 12/1962 | Diehl | 60/303 |
| 3,197,956 | 8/1956 | Clarke | 60/303 |
| 3,445,195 | 5/1969 | Benteler | 60/300 |
| 3,503,716 | 3/1970 | Berger | 60/286 |
| 3,577,727 | 5/1971 | Warren | 60/292 |
| 3,672,171 | 6/1972 | Eknayan | 60/297 |

*Primary Examiner*—Douglas Hart
*Attorney, Agent, or Firm*—Michael J. Striker

[57] ABSTRACT

A method of treating exhaust gases of internal combustion engines to eliminate therefrom its toxic constituents especially carbon monoxide, which includes the steps of passing the exhaust gases before discharge into the atmosphere through an enclosure and heating the same during the passage to such a temperature so as to cause transformation of the toxic constituents into nontoxic constituents, and an apparatus for carrying out the method.

4 Claims, 1 Drawing Figure

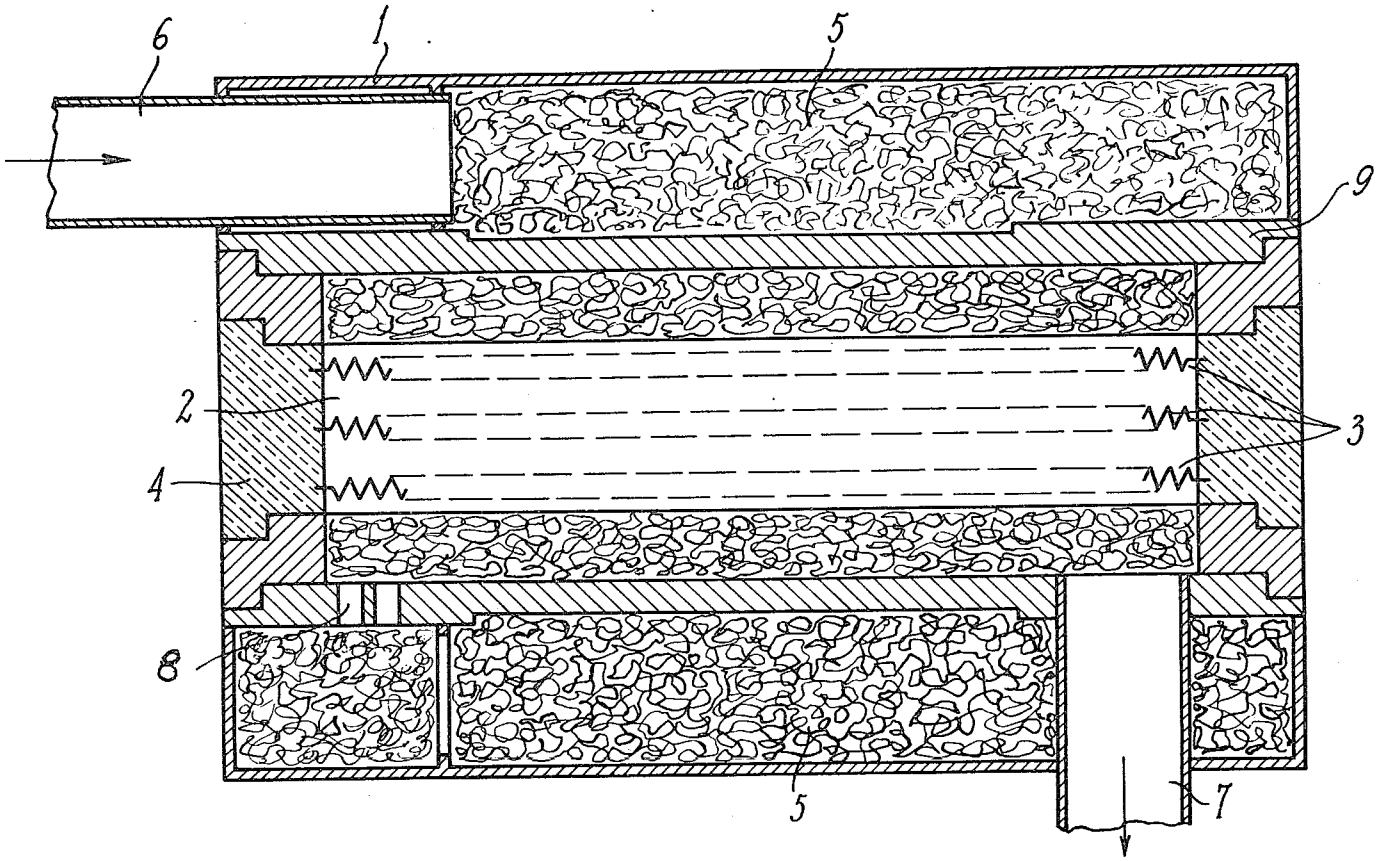
1
2
3
4
5
5
6
7
8
9

APPARATUS FOR TREATING EXHAUST GASES OF INTERNAL COMBUSTION ENGINES

BACKGROUND OF THE INVENTION

The present invention relates to a process of treating the exhaust gases of internal combustion engines to eliminate therefrom its toxic constituents, as well as to an apparatus for carrying out the method.

The apparatus for treating the exhaust gases of internal combustion engines, such as mufflers presently used, do not solve in a satisfactory fashion the problem of pollution of the atmosphere by the exhaust gases as the same are ejected into the atmosphere. Actually the mufflers presently used have only the function to dampen the noise of the exhaust gases while these mufflers in no way eliminate the toxic components contained in the exhaust gases before discharge of the same into the atmosphere.

SUMMARY OF THE INVENTION

It is an object of the present invention to provide for a method and an apparatus for treating the exhaust gases of internal combustion engines in such a manner that the toxic constituents contained in the exhaust gases will be practically eliminated before the gases are ejected into the atmosphere so that the ejected gases will not contribute to the pollution of the atmosphere and in which the method and apparatus of the present invention will at the same time perform the noise dampening which is performed by the mufflers according to the prior art.

It is a further object of the present invention to provide for such an apparatus for treating exhaust gases which is simple in construction so that it can be manufactured at reasonable cost and will stand up perfectly under extended use.

With these objects in view, the method of treating exhaust gases of internal combustion engines to eliminate therefrom its toxic constituents, especially carbon monoxide, mainly comprises the step of heating the exhaust gas, before discharging the same into the outer atmosphere, to a temperature sufficient to transform the toxic constituents and especially the carbon monoxide contained therein into nontoxic constituents.

More specifically, the exhaust gas is heated to a temperature of 300°–500° C before its discharge into the atmosphere.

Preferably, the gas is guided along a tortuous path during its heating to the aforementioned temperature so that the gas is subjected for a relatively long time to this high temperature before its discharge into the atmosphere.

The apparatus according to the present invention for treating exhaust gas of internal combustion engines to eliminate therefrom its toxic constituents, especially carbon monoxide, mainly comprises an enclosure, inlet means for feeding exhaust gas from an internal combustion engine into the enclosure, means for heating the interior of the enclosure to transform the toxic components of the exhaust gas fed thereinto into nontoxic components, and means for discharging the thus treated exhaust gas from the enclosure.

Preferably, the aforementioned enclosure is surrounded by an outer shell which is spaced from the enclosure. In this case, the inlet means communicate with the outer shell and the outlet means with the interior of the enclosure, and passage means provide communication between the outer shell and the enclosure. In this arrangement means are preferably provided at least in the space between the outer shell and the enclosure for forming a tortuous path for the gas passing from the inlet to the outlet means. Preferably, the enclosure is formed in this case from a material of high heat conducting capacity.

The aforementioned means for providing a tortuous path may be constituted by metallic sponge material filling at least the space between the outer shell and the enclosure.

The means for heating the interior of the enclosure may be constituted by electrical resistance wires passing through the interior of the enclosure or embedded in the walls thereof, which wires are adapted to be connected to a source of electrical energy so as to heat the same.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single drawing is an axial cross section through the apparatus according to the present invention.

DESCRIPTION OF THE PREFERRED EMBODIMENTS

Referring now to the drawing, it will be seen that the apparatus according to the present invention mainly comprises an outer tube or outer shell 1 of cylindrical configuration which forms the main muffler. The walls of the shell 1 are formed from material which is usually used in fabrication of mufflers, such as steel or a non-ferrous material, for instance an aluminum-antimony alloy, etc.

Substantially coaxially arranged within the outer cylindrical shell 1 is a likewise substantially cylindrical enclosure 9 forming in the interior thereof a chamber 2. The walls of the enclosure are formed from a material of high heat conductive capacity, for instance, of refractory metal, steel 18/8, etc.

In the specific construction illustrated in the drawing, the interior of the chamber 2 is heated by means of a plurality of electric resistance wires 3 which extend in axial direction through the chamber and which are mounted on opposite ends thereof in blocks of ceramic material 4 inserted at opposite end walls of the chamber. The resistance wires 3 may be connected in well-known manner, not shown in the drawing, to a source of electrical energy, likewise not illustrated, so that an electric current may be passed through the wires 3 to thereby heat the same and therewith the interior of the chamber 2. However, it is to be understood that the interior of the chamber 2 may also be heated by other means, and the resistance wires may also be arranged in a different manner than shown in the drawing, for instance the resistance wires may be embedded in the walls of the enclosure forming the chamber 2, in which case these walls have to be made from electrically insulating material which however should, as mentioned before, have a high heat conductive capacity.

The space between the peripheral wall of the outer shell and the peripheral wall of the inner enclosure forming the chamber 2 is filled with material 5 which forms obstacles for the gas passing through this space in order to prolong the passage of the combustion gas through the apparatus and which therefore assures a prolongation of the time of circulation of the gas in the apparatus and therewith the time the gas is subjected to the heat developed in the chamber 2.

The material 5 which forms obstacles for the passage of the gas through the apparatus is preferably constituted by a metallic sponge. This material 5 may not only be used to fill the space between the wall of the outer shell and the inner enclosure, but such material may also be applied to the inner surface of the wall of the enclosure, as shown in the drawing, but in this case, of course, care must be taken that the materal 5 does not contact the resistance wires 3 passing through the chamber 2. The material 5 in the space between the walls of the outer shell and the inner enclosure not only forms a tortuous path for the exhaust gas but serves also as sound absorber so that the gas, when finally ejected into the atmosphere, will not produce any noise.

As shown in the drawing, the exhaust gas from an internal combustion engine is fed into the space between the outer shell and the inner enclosure by means of a tube 6 so that the gas passing through the space filled with the sponge material is heated, since as mentioned before, the wall of the inner enclosure is formed from a material having a high heat conductive capacity. The gas passes then from the annular space between the outer shell and the inner enclosure through passage means 8 into the interior of the inner enclosure to be further heated therein by the heat developed by the resistance wires 3 and the gas is finally discharged to the outer atmosphere by an outlet tube 7 communicating at the inner end thereof with the interior of the chamber 2.

The length and the resistance of the wires 3 and the electric energy supplied thereto has to be such that the temperature maintained in the chamber 2 is sufficient to transform the toxic constituents contained in the exhaust gas and especially the carbon monoxide into nontoxic constituents. Advantageously, the temperature maintained in the interior of the chamber 2 is between 300° and 500° C.

As known, the exhaust gas from internal combustion engines, which at the present time are ejected through muffler constructions known in the art into the atmosphere, contain 3–9% of CO.

Analysis of the exhaust gas resulting from the combustion of gasoline containing lead chromate after being passed through the apparatus of the present invention have given the following results:

$CO_2 = 11.7\%$;
$O_2 = 1.1\%$; and
$CO = 0\%$.

It is understood without saying that exhaust gas which results from combustion of gasoline deprived of lead chromate, when treated according to the present invention will also show a corresponding very sensible reduction of the CO content of the exhaust gas.

The result of the analysis of exhaust gas from internal combustion engines proves that such exhaust gas, when treated according to the present invention, is deprived totally of carbon monoxide and the apparatus of the present invention can be constructed in a very simple manner while reducing the pollution of the atmosphere resulting from exhaust gases of motor vehicles in a decisive way.

The method according to the present invention and the apparatus for carrying out the method as described above will therefore provide highly advantageous results as compared with mufflers known in the art.

It will be understood that each of the elements described above, or two or more together, may also find a useful application in other types of apparatus for treating exhaust gases of internal combustion engines differing from the types described above.

While the invention has been illustrated and described as embodied in an apparatus for treating exhaust gases of internal combustion engines to transform the toxic constituents contained therein, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed as new and desired to be protected by Letters Patent is set forth in the appended claims:

1. Apparatus for treating exhaust gas of internal combustion engines to eliminate therefrom its toxic constituents, especially carbon monoxide, comprising an outer shell of substantially cylindrical configuration; an inner substantially cylindrical enclosure having a peripheral wall of a material of high conductive capacity arranged spaced from and substantially coaxial with said outer shell in the latter; inlet means for feeding only exhaust gas from an internal combustion engine into said outer shell; passage means providing communication between the interior of the outer shell and the interior of said enclosure; means for heating the interior of said enclosure to a temperature so as to transform the toxic components of the exhaust gas fed thereinto into nontoxic components and to simultaneously preheat the exhaust gas in said outer shell through the heat conductive peripheral wall of said enclosure; means filling at least the space between said outer shell and said enclosure for providing a tortuous path for the exhaust gas passing therethrough; and outlet means communicating with the interior of said enclosure for discharging the treated exhaust gas therefrom.

2. An apparatus as defined in claim 1, wherein said means for providing a tortuous path are constituted by metallic sponge material filling at least the space between said outer shell and said enclosure.

3. An apparatus as defined in claim 1, wherein said passage means which provides communication between said outer shell and said enclosure are radially spaced from said inlet means and axially spaced from said outlet means.

4. An apparatus as defined in claim 1, wherein said heating means are constituted by electrical resistance wires extending through the interior of said enclosure and adapted to be connected to a source of electrical energy.

* * * * *